US006014104A

United States Patent [19]

Imae et al.

[11] Patent Number: 6,014,104

[45] Date of Patent: Jan. 11, 2000

[54] METHOD FOR MONITORING YARN TENSION IN YARN MANUFACTURING PROCESS

[75] Inventors: Masazumi Imae, Moriyama; Takashi Iwade, Soraku-gun; Yukiko Shintani, Otsu, all of Japan

[73] Assignee: Toray Engineering Co., Ltd., Osaka, Japan

[21] Appl. No.: 09/083,117

[22] Filed: May 22, 1998

[30] Foreign Application Priority Data

May 26, 1997 [JP] Japan ..... 9-152938

[51] Int. Cl.[7] ..... B65H 54/00; G06F 19/00; G02B 6/18

[52] U.S. Cl. ..... 342/485; 364/470.1; 364/1.24; 364/40.1; 425/135

[58] Field of Search ..... 242/487.3, 485, 242/920; 364/470.1, 470.14, 470.15; 264/40.1, 1.24; 425/135

[56] References Cited

U.S. PATENT DOCUMENTS

| | | | |
|---|---|---|---|
| 3,683,160 | 8/1972 | Windley | 364/470.15 |
| 4,195,345 | 3/1980 | Artzt et al. | 364/470.1 |
| 4,394,986 | 7/1983 | Hasegawa et al. . | |
| 5,463,557 | 10/1995 | Nakano et al. | 364/470.1 |
| 5,621,637 | 4/1997 | Spahlinger | 364/470.1 X |
| 5,710,708 | 1/1998 | Wiegand | 364/470.1 |

FOREIGN PATENT DOCUMENTS 0 439 106 7/1991 European Pat. Off. .

*Primary Examiner*—Michael R. Mansen
*Attorney, Agent, or Firm*—Burns, Doane, Swecker & Mathis, L.L.P.

[57] ABSTRACT

The yarn manufacturing process is monitored by detecting a yarn tension while the yarn spun by a spinning device is wound by a winding device. The yarn tension detected by the yarn tension sensor is corrected based on the rate of change in a winding condition such as a traverse speed or a winding speed, and whether the yarn manufacturing process is in a normal condition or not is judged based on the corrected tension. Also, an abnormal judging reference is corrected based on the rate of change in a winding condition, and whether the yarn manufacturing process is in a normal condition or not is judged based on the corrected abnormal judging reference.

4 Claims, 8 Drawing Sheets

METHOD FOR MONITORING YARN TENSION IN YARN MANUFACTURING PROCESS

BACKGROUND OF THE INVENTION

1. Field of the Invention

The present invention relates to a method for monitoring yarn tension in a yarn manufacturing process while the yarn spun by a spinning device is wound by a winding device.

2. Description of the Related Art

Recently, in a yarn manufacturing process for manufacturing a synthetic fiber yarn such as polyamide or polyester, a yarn spun by a spinning device is wound by a winding device including a traverse mechanism, a spindle for attaching a bobbin thereto, a contact roller adapted to contact the yarn wound around the bobbin to apply a surface pressure to the yarn, and a winding condition detecting means. A tension of the yarn is always detected by a yarn tension detecting means arranged on the upstream side of the winding device, to monitor the yarn manufacturing process and to detect whether the manufacturing process is in a normal condition or not, by analyzing the detected tension.

The yarn tension detected by the yarn tension detecting means varies due to several factors. The variation in the yarn tension is caused, on one hand, by a real abnormality in the yarn manufacturing process and, on the other hand, by the production factors. One of the tension variations due to the production factors is based on a change in a manufacturing condition such as a change in a traverse speed and a change in a rotational speed of the spindle.

The yarn is wound by the winding device under one of several different traversing methods. For example, the random traversing method, the ribbon jump traversing method, the programmed traversing method, the multi-wind traversing method, and the combination of these traversing methods are known. For example, FIG. 3 shows the random traversing method in which the traverse speed is cyclically changed to effect ribbon break while the traversing angle is maintained constant. FIG. 4 shows the ribbon jump traversing method in which the traverse speed is suddenly changed at ribbon regions only while the traversing angle is maintained constant. FIG. 5 shows the programmed traversing method in which the traverse speed is always changed from the start of the winding to the end of the winding to change traversing angles. FIG. 6 shows the multi-wind traversing method in which the traverse speed is changed to change the winding ratio at every ribbon region. The traverse speed largely varies in these cases.

In addition, in the winding speed changing winding, the rotational speed of the spindle varies from the start of the winding to the end of the winding, as shown in FIG. 7.

If the traverse speed varies, the yarn tension varies in proportion to the change of the traverse speed, as shown in FIGS. 3 to 6, and the yarn tension may be out of an abnormal judging reference having a predetermined range, so that the yarn manufacturing process may be judged to be in an abnormal condition and the abnormal signal is thus outputted.

In addition, if the winding speed varies, the yarn tension varies in proportion to the winding speed, as shown in FIG. 7, so that the variation of the yarn tension from the start of the winding to the end of the winding becomes larger and exceeds the allowed abnormal judging reference range in the yarn winding operation, so that the yarn manufacturing process is judged to be in an abnormal condition when the detected tension is out of the abnormal judging reference range and the abnormal signal is thus outputted.

In this way, there is a case where the abnormal signal is outputted even though the winding condition is normal, and it is difficult to distinguish the variation of the yarn tension due to a real abnormality in the yarn manufacturing process from the variation of the yarn tension inevitably arising depending on the manufacturing conditions.

In order to avoid the output of the abnormal signal due to a variation of the yarn tension arising from the manufacturing conditions, it is necessary to broaden the range between the upper limit and the lower limit of the abnormal judging reference. However, there is a problem in that a real abnormality which produces only a small change in the tension, such as a change in the amount of oil attached to the yarn, filament break, and a change in the polymer viscosity, is not always detected.

SUMMARY OF THE INVENTION

The object of the present invention is to provide a method for monitoring tension of a yarn in a yarn manufacturing process by which any abnormality in the yarn manufacturing process can be reliably detected but a variation in the yarn tension arising from the traverse speed variation and the winding speed variation is not detected to be abnormal.

According to the present invention, there is provided a method for monitoring a tension of a yarn in a yarn manufacturing process to detect an abnormality in the yarn manufacturing process while the yarn spun by a spinning device is wound by a winding device including a traverse mechanism, a spindle for attaching a bobbin thereto, and a contact roller adapted to contact the yarn wound around the bobbin to apply a surface pressure to the yarn, said tension of the yarn being detected by a yarn tension detecting means arranged on the upstream side of the winding device.

In one aspect of the present invention, the method comprises correcting the tension detected by the yarn tension detecting means in correspondence with the rate of change in the winding condition detected by a winding condition detecting means, and judging whether the yarn manufacturing process is in a normal condition or not with reference to the corrected tension.

In another aspect of the present invention, the method comprises the steps of correcting an abnormal judging reference in correspondence with the rate of change in the winding condition detected by a winding condition detecting means, and judging whether the yarn manufacturing process is in a normal condition or not with reference to the corrected abnormal judging reference.

Preferably, the winding condition to be detected is one of a transverse speed and a winding speed.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
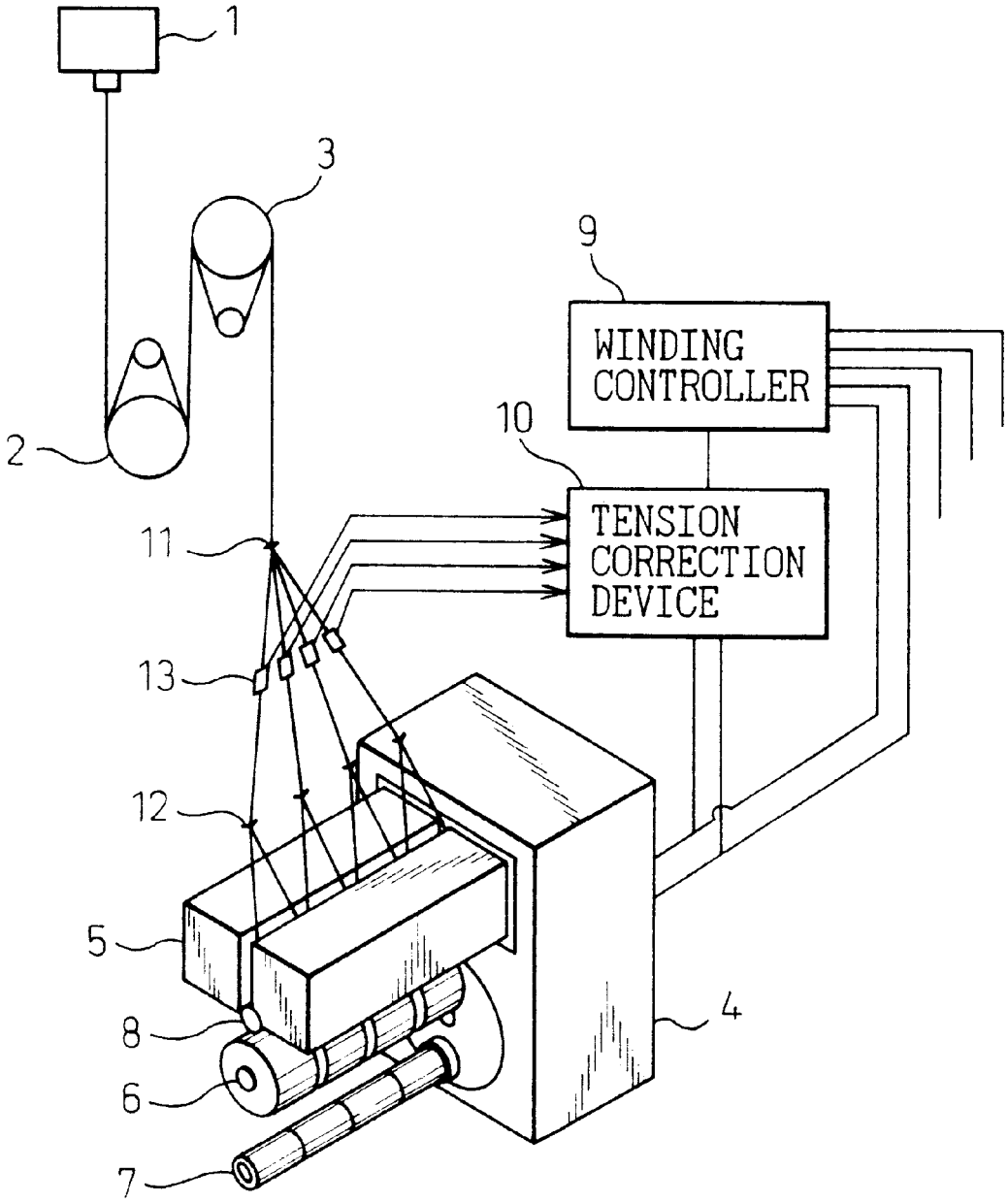
FIG. 1 is a diagrammatic perspective view of a yarn manufacturing apparatus according to the embodiment of the present invention.
Figure 2:
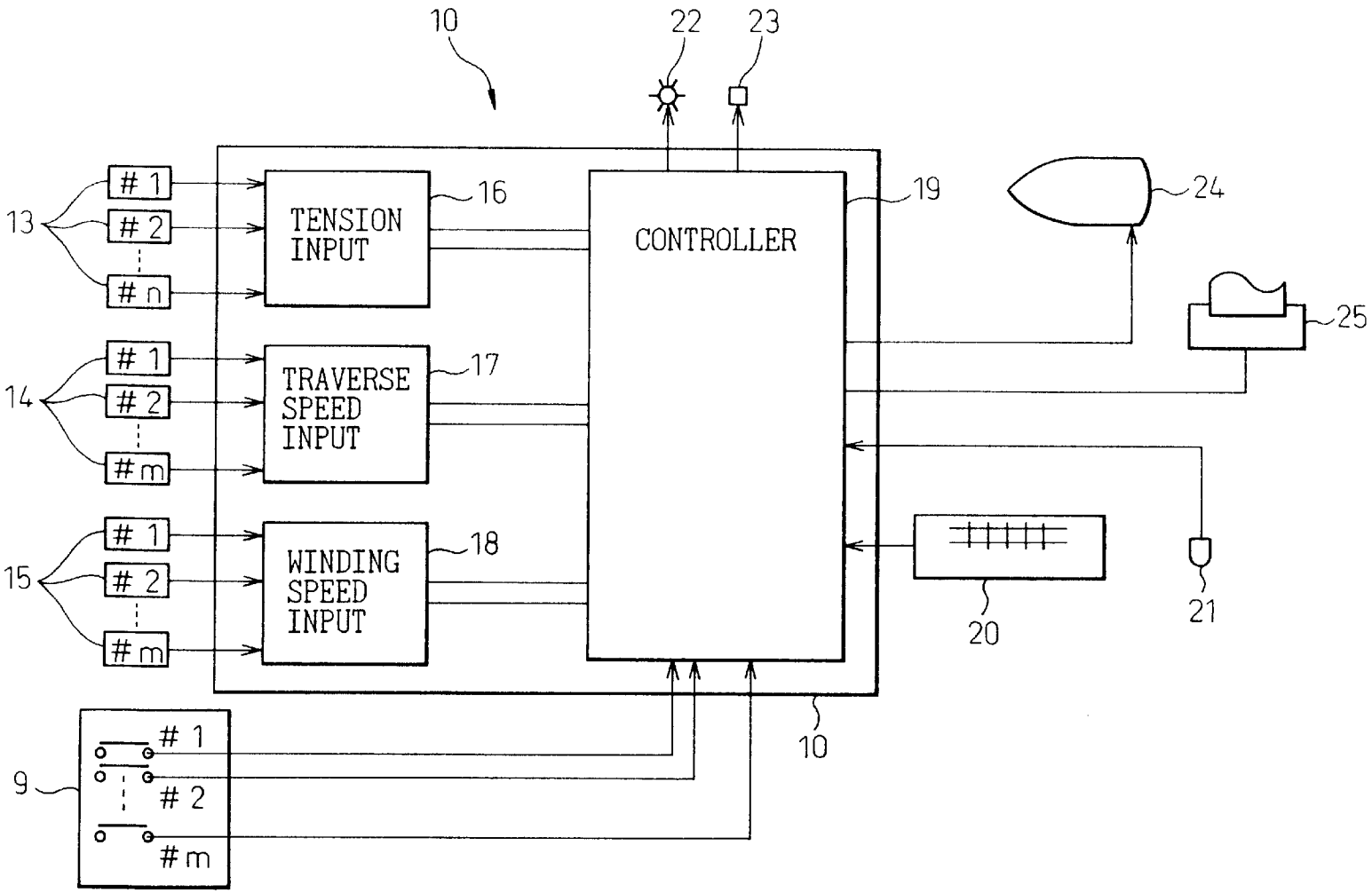
FIG. 2 is a block diagram illustrating the embodiment of the present invention for realizing a method for monitoring tension of a yarn in a yarn manufacturing process.
Figure 3:
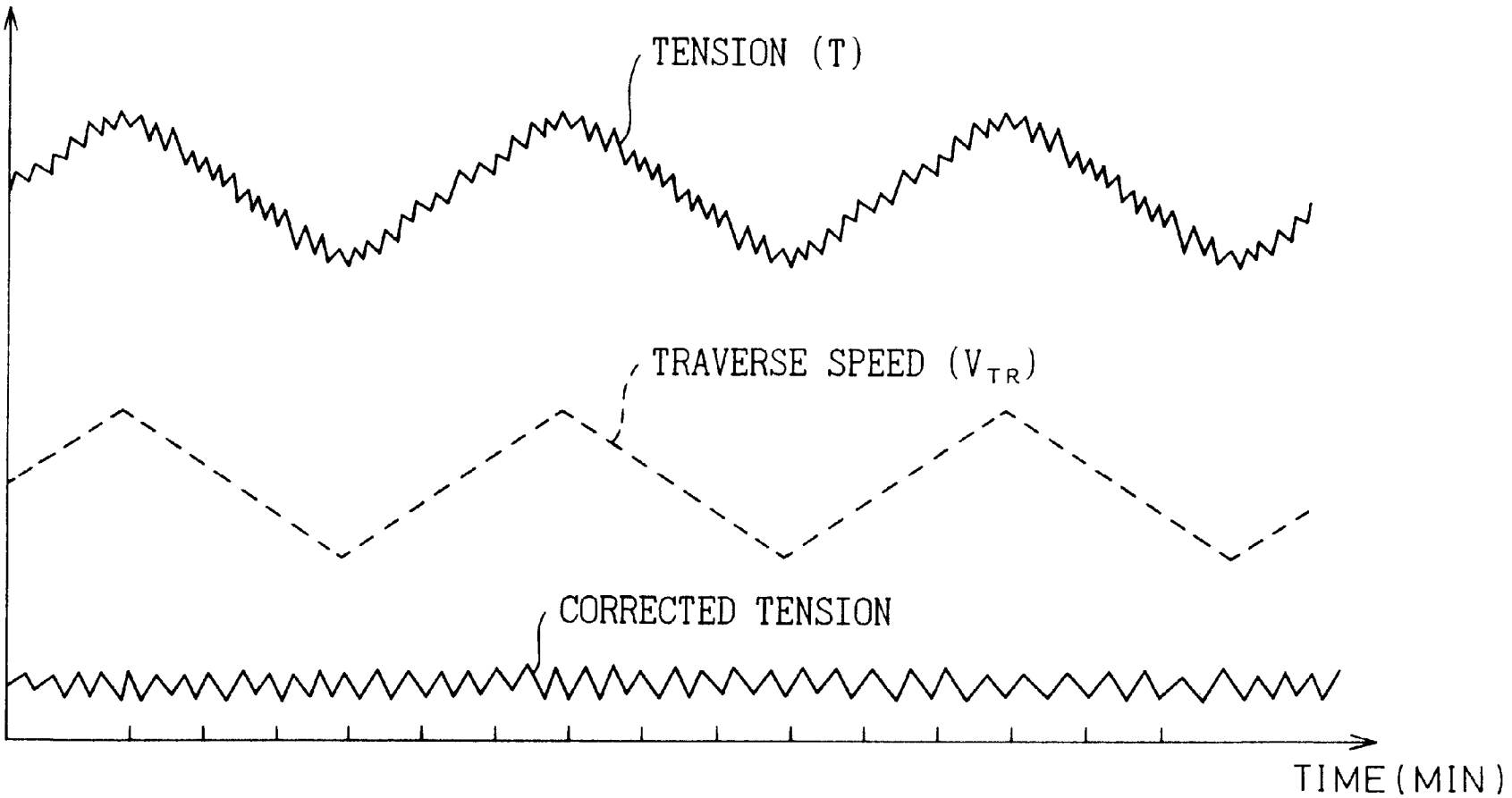
FIG. 3 is a view illustrating the traverse speed, the yarn tension, and the corrected yarn tension in the random traversing method.
Figure 4:
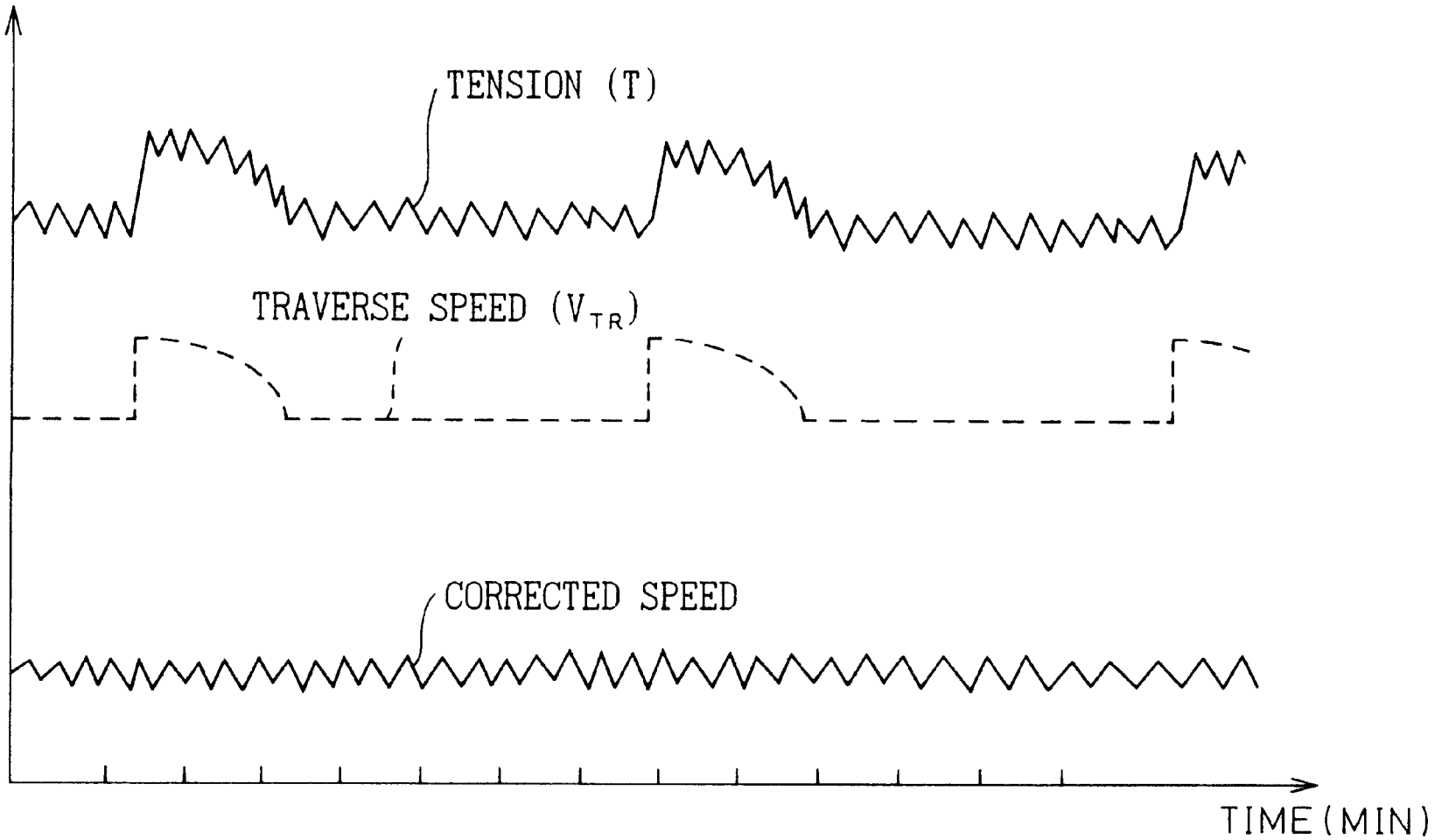
FIG. 4 is a view illustrating the traverse speed, the yarn tension, and the corrected yarn tension in the ribbon jump traversing method.
Figure 5:
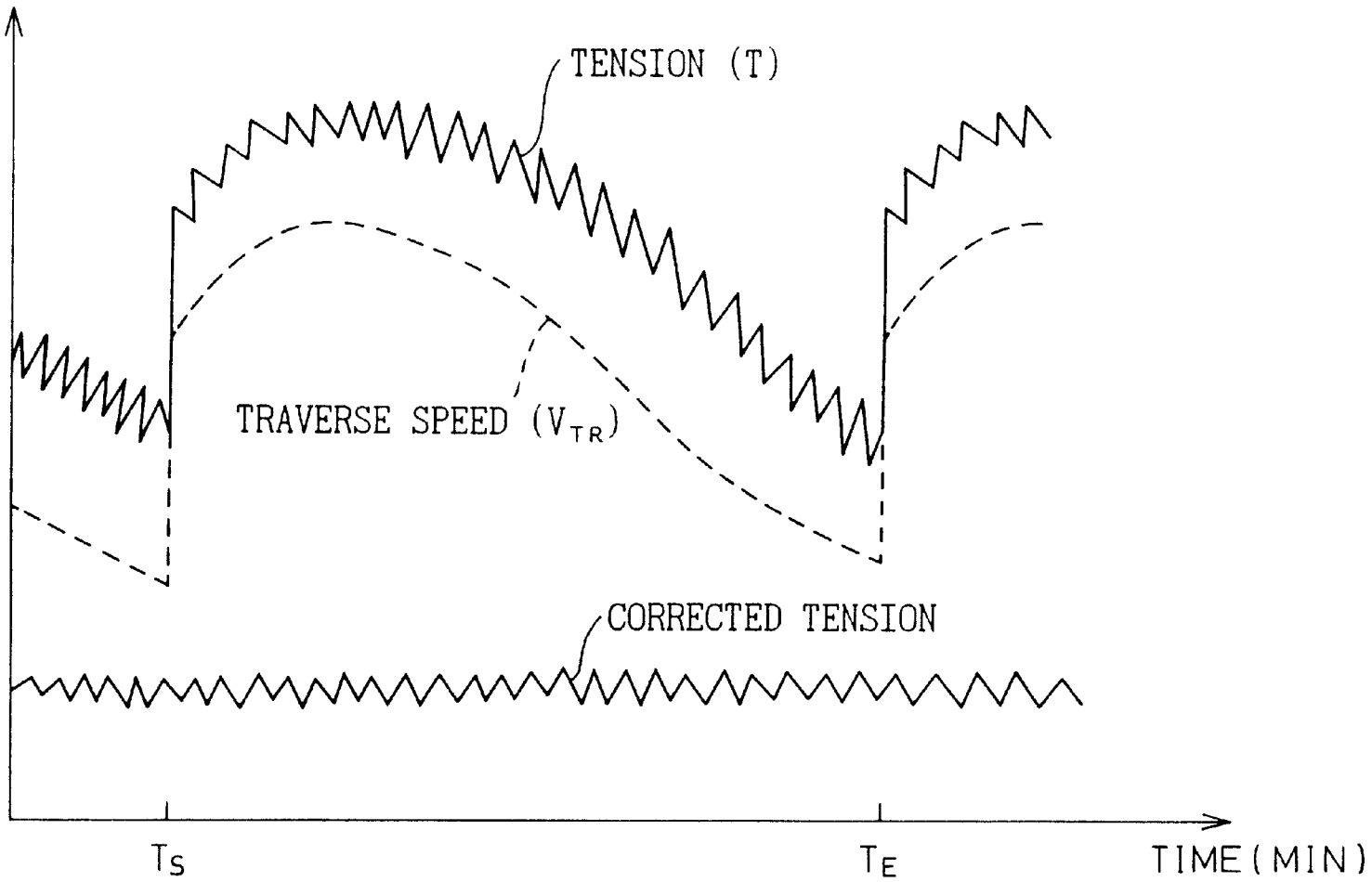
FIG. 5 is a view illustrating the traverse speed, the yarn tension, and the corrected yarn tension in the programmed traversing method.
Figure 6:
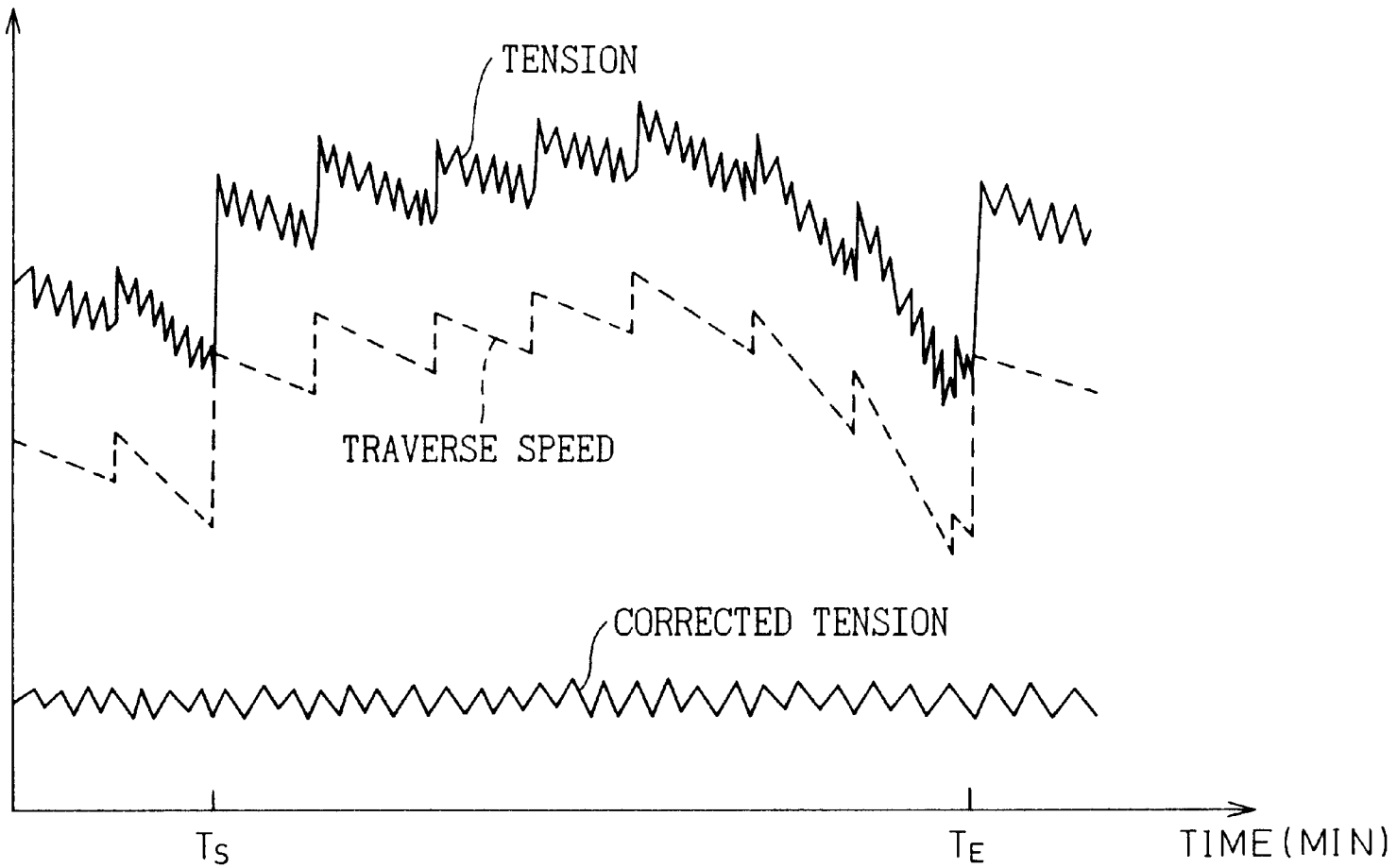
FIG. 6 is a view illustrating the traverse speed, the yarn tension, and the corrected yarn tension in the multi-wind traversing method with changing crossing angle.

FIG. 1 is a diagrammatic perspective view of a yarn manufacturing apparatus according to the embodiment of the present invention, and FIG. 2 is a block diagram illustrating the embodiment of the present invention for realizing the method for monitoring tension of a yarn in a yarn manufacturing process.

The yarn manufacturing apparatus comprises a spinning device 1 including a metering pump and a ferrule for spinning a yarn from a molten polymer, a first take-up roller 2 to receive and pull the spun yarn at a predetermined speed, a second take-up roller 3, a winding device 4 including a traverse mechanism 5, a revolving member having two spindles 6 and 7 rotatably attached thereto, a contact roller 8, a winding control device 9 arranged near the winding device 4, and a tension correcting device 10.

A yarn dividing guide 11 and fulcrum guides 12 are arranged at appropriate positions between the second take-up roller 3 and the winding device 4 and supported by a support member (not shown). Tension sensors 13 as a yarn tension detecting means are arranged at appropriate positions between the yarn dividing guide 11 and the fulcrum guides 12 and supported by a support member (not shown).

A three point contact type sensor or a non-contact type sensor can be used as the tension sensor 13, and the detection signal is delivered from the tension sensor 13 to the tension correcting device 10.

The winding device 4 has a traverse speed sensor 14 for detecting the traverse speed and a winding speed sensor (a sensor detecting the rotational speed of the spindles 6 and 7 or the contact roller 8) 15 acting as a winding condition detecting means for detecting the winding speed. The detection signal is delivered from these sensors 14 and 15 to the tension correcting device 10.

The winding control device 9 has line controllers (not shown) connected thereto, and the speed of the traverse mechanism 5 and the speed of the spindles 6 and 7 of the winding device 4 are controlled by the line controllers. If a plurality of winding devices 4 are provided, each of the winding devices 4 is controlled by the respective line controllers.

The tension correcting device 10 receives the detection signals from a plurality of winding devices 4 (4-1 to 4-m), and has a tension signal input 16 connected to the tension sensors 13 (13-1 to 13-n), a traverse speed signal input 17 connected to the traverse speed sensors 14 (14-1 to 14-m), a winding speed input 18 connected to the winding speed sensors 15 (15-1 to 15-m), and a controller part 19 for effecting a tension correcting processing. A keyboard 20 and a mouse 21 for manually inputting data, an alarm lamp 22, an alarm buzzer 23, a display 24, and a printer 25 for writing data are connected to the tension correcting device 10. It is possible to output the abnormal data through the printer 25.

It is also possible to arrange one tension sensor 13 for one winding device 4.

The tension signal input 16 has a low pass filter to remove any unnecessary components in the signal delivered from the tension sensors 13 if the detection signal delivered from the tension sensors 13 is an analogue signal, and the cutoff frequency (fc) is near 5 Hz. An analogue hardware circuit or a software digital filter can be used as the low pass filter. If the detection signal delivered from the tension sensors 13 is a digital signal, the tension signal input 16 has a converter to convert the parallel signal to the serial signal.

The traverse speed signal input 17 counts the detection signal delivered from the traverse speed sensors 14 and outputs it to the controller part 19. The winding speed input 18 counts the detection signal delivered from the winding speed sensors 15 and outputs it to the controller part 19.

The controller part 19 can be composed of a microcomputer, a personal computer or a programmable logic computer. A full winding advance signal is delivered from the winding control device 9 to the controller part 19, so that an abnormal signal arising from the tension variation is not output when the full bobbin is changed to an empty bobbin.

The present invention utilizes the rate of change ΔT in the yarn tension T. Analysis is first carried out to obtain the relationship between the rate of change ΔT in the yarn tension and the rate of change $\Delta V_{TR}$ in the traverse speed $V_{TR}$, the traversing methods as identified above, the kind of yarn, the winding speed, and the traverse speed. It has become apparent that the rate of change ΔT in the yarn tension is in the range ±(3–15)%, when the rate of change $\Delta V_{TR}$ in the traverse speed is ±10%.

This relationship can be expressed by the following equations.

$$\Delta V_{TR} = \frac{V_{TR}(0) - V_{TR}(-1)}{V_{TR}(-1)} \tag{1}$$

wherein $V_{TR}$ (0) is the current value of the traverse speed $V_{TR}$, and $V_{TR}$ (−1) is the previous value of the traverse speed $V_{TR}$ before the change.

$$\Delta T = \frac{T(0) - T(-1)}{T(-1)} \tag{2}$$

wherein T (0) is the current value of the tension T, and T (−1) is the previous value of the tension before the change.

$$\Delta T = K_{TR} \times \Delta V_{TR} \tag{3}$$

This is the relationship between the rate of change ΔT in the yarn tension and the rate of change $\Delta V_{TR}$ in the traverse speed, and $K_{TR}$ is a correction factor. The correction factor $K_{TR}$ can be an appropriate value existing in the range from 0.3 to 1.5.

Therefore, it is possible to calculate the varied tension DT, which is caused due to the change of the traverse speed, using the correction factor $K_{TR}$, which is obtained by the experimentally detected values and the relationship between the rate of change ΔT in the yarn tension and the rate of change $\Delta V_{TR}$ in the traverse speed. The corrected tension CT can be calculated by subtracting the varied tension DT from the detected current tension T (0), as follows.

$$CT=T(0)-DT \quad (4)$$

The corrected tension CT can be used to judge the abnormality of the yarn manufacturing process. When an abnormal judging reference determined as a function of the detected tension T is used to judge the abnormality of the yarn manufacturing process, the abnormal judging reference is changed in correspondence with the rate of change ΔT in the yarn tension, so that any abnormality may not be detected in the variation in the yarn tension arising from the variation of the traverse speed.

(EXAMPLE 1)

The following experiment was carried out. The used yarn was polyester drawn yarn 75D-36f, the winding speed was 4800 m/min, the traverse speed was approximately 500 m/min, and the traverse speed correction factor $K_{TR}$ was 0.75. The tension detected by the tension sensor 13 was corrected using the rate of change $\Delta V_{TR}$ in the traverse speed detected by the traverse speed sensor 14, so that the tension value was corrected in the reverse direction (reverse sign). The result is shown by the curves represented by "CORRECTED TENSION" in FIGS. 3 to 6, whereby it is possible to complete the winding operation without outputting any unnecessary abnormal signal.

In FIGS. 3 to 8, three curves are described in the optional scales and are purposely vertically shifted to each other so that they are not superimposed to each other, to show the features of the respective curves.

It is also possible to use a winding condition command signal delivered from the winding control device 9 to the traverse mechanism 5 as a traverse speed to correct the detected tension, in place of the value detected by the traverse speed sensor 14 in the illustrated embodiment.

Figure 7:
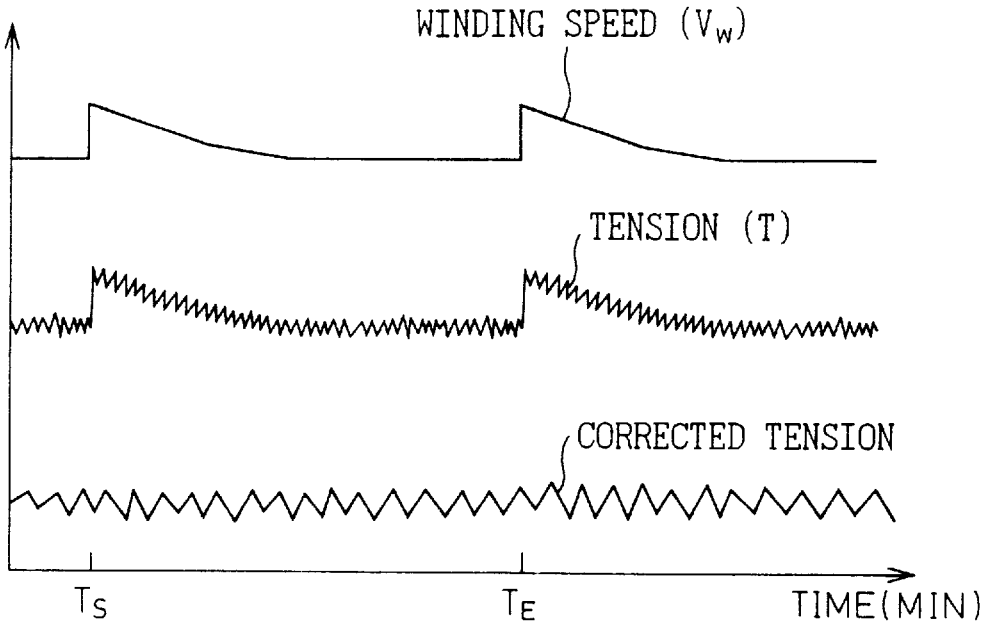
FIG. 7 is a view illustrating the winding speed, the yarn tension, and the corrected yarn tension.

Next, the yarn tension T and the winding speed $V_W$ are then measured, and the result is shown in FIG. 7. The rate of change $\Delta V_W$, in the winding speed $V_W$ is expressed as follows:

$$\Delta V_w = \frac{V_w(0) - V_w(-1)}{V_w(-1)} \quad (5)$$

wherein $V_W(0)$ is the current value of the winding speed $V_W$ and $V_W(-1)$ is the previous value of the winding speed $V_W$ before the change. The equation (2) is also applied in this case.

The relationship between the rate of change ΔT in the yarn tension and the rate of change $\Delta V_W$, in the WINDING speed $V_W$ is expressed as follows:

$$\Delta T=K_W\times\Delta V_W \quad (6)$$

The relationship between the rate of change ΔT in the yarn tension and the rate of change $\Delta V_W$ in the WINDING speed $V_W$ is then measured, and the result is shown in FIG. 7. The correction factor $K_W$ can be obtained in a manner similar to the correction factor $K_{TR}$, and the correction factor $K_W$ is in the range from 30 to 150.

It will be apparent that the abnormal judging reference is changed based on the rate of change ΔT in the yarn tension so that an abnormality is not detected when a variation in the yarn tension, due to the variation of the traverse speed, occurs.

(EXAMPLE 2)

The following experiment was carried out wherein the used yarn was polyester drawn yarn 75D-36f, the winding speed was 4800 m/min, the traverse speed was approximately 500 m/min, and the winding speed correction factor $K_W$ was 65. The tension detected by the tension sensor 13 was corrected using the rate of change $\Delta V_W$ in the winding speed detected by the winding speed sensor 15, so that the detected value was corrected in the reverse direction (reverse sign). The result is shown by the curve represented by "CORRECTED TENSION" in FIG. 7, whereby it is possible to complete the winding operation without outputting any abnormal signal.

It is also possible to use a winding condition command signal delivered from the winding control device 9 to the traverse mechanism 5 as a winding speed value to correct the detected tension, in place of the value detected by the winding speed sensor 15 in the illustrated embodiment.

It will be apparent that the abnormal judging reference is changed based on the rate of change ΔT in the yarn tension so that abnormality is not detected when a variation in the tension, due to the variation of the traverse speed, occurs.

The above illustrated embodiments can be revised in the controller part 19 in the tension correcting device 10 in such a manner that the abnormal judging reference range be changed by the corrected tension CT calculated based on the tension T detected by the tension sensor 13 and the varied tension DT which is calculated based on the rate of change $\Delta T_{TR}$ or $\Delta T_W$ in the traverse speed or the winding speed which is detected by the traverse speed sensor 14 or the winding speed sensor 15, whereby the abnormality of the process can be judged.

Figure 8:
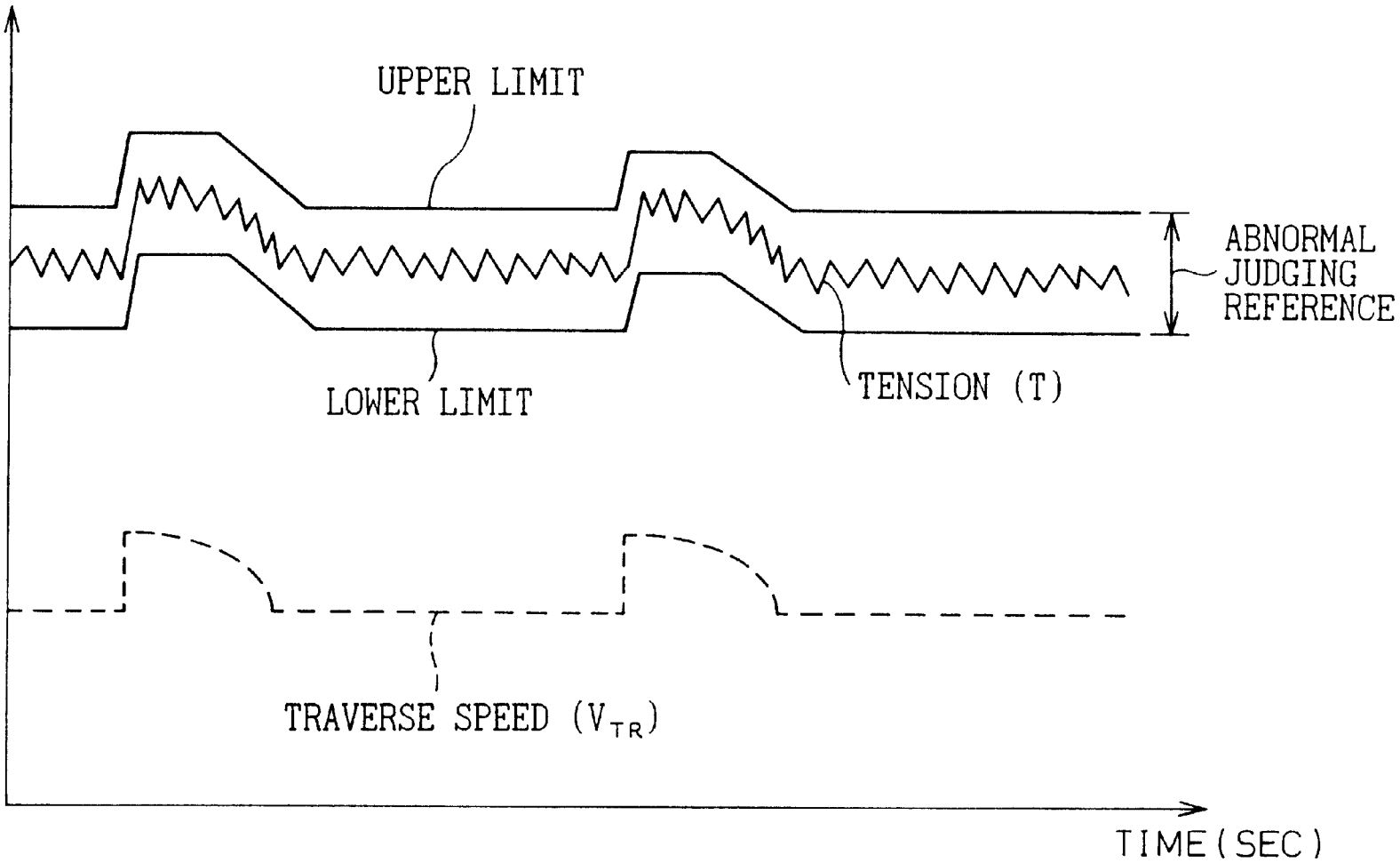
FIG. 8 is a view illustrating the traverse speed, the yarn tension, and the abnormal judging reference to correct the latter.

FIG. 8 shows the corrected abnormal judging reference. In this case, the winding is carried out by the ribbon jump traversing method, and the traverse speed is detected at the interval of 1 to 5 seconds, preferably 1 second. In FIG. 8, the dotted line represents the detected traverse speed, and the abnormal judging reference is in the range between the upper limit and the lower limit. The upper and lower limits are corrected in correspondence with the rate of change $\Delta T_{TR}$ in the traverse speed detected by the traverse speed sensor 14 so that the tension T detected by the tension sensor 13 is compared with the corrected abnormal judging reference to detect the abnormality of the process.

It is also possible to use the following equations (7) and (8), in place of the equations (3) and (6) for determining $K_{TR}$ and $K_W$ $$\frac{T(0)}{T(-1)} = K'_{TR} \times \frac{V_{TR}(0)}{V_{TR}(-1)} \quad (7)$$

where the tension T and the traverse speed $V_{TR}$ are used.

$$\frac{T(0)}{T(-1)} = K'_{w} \times \frac{V_{w}(0)}{V_{w}(-1)} \quad (8)$$

where the tension T and the winding speed $V_W$ are used.

For example, the correction factor $K_{TR}'$ is in the range from 0.93 to 1.05, and the correction factor $K_W'$ is in the range from 3.6 to 14.5.

In this case, the correction is carried out by multiplying the detected tension T (0) by the correction factor $K_{TR}'$ or $K_W'$. It is also possible to multiply the abnormal reference by the correction factor $K_{TR}'$ or $K_W'$.

It is also possible to arrange that the above described correction factors $K_{TR}$, $K_W$, $K_{TR}'$ and $K_W'$ are not constants but functions of the traverse speed $V_{TR}$ and the winding speed $V_W$.

That is, it is possible to determine $K_{TR}$ as follows.

$$K_{TR}=f(V_{TR}) \quad (9)$$

wherein the winding speed can be inserted in the approximate expression.

It is apparent that the present invention is not limited to the above described equations.

As described in greater detail, according to the present invention, it is possible to reliably detect any abnormality in the yarn manufacturing process, without undesirably judging the variation of the yarn tension due to due to the traverse speed variation and the winding speed variation as the abnormality.

We claim:

1. A method for monitoring a tension of a yarn in a yarn manufacturing process to detect an abnormality of the yarn manufacturing process while the yarn spun by a spinning device is wound by a winding device including a traverse mechanism, a spindle for attaching a bobbin thereto, and a contact roller adapted to contact the yarn wound around the bobbin to apply a surface pressure to the yarn, said tension of the yarn being detected by a yarn tension detecting means arranged on the upstream side of the winding device, said method comprising the steps of:

detecting a winding condition by a winding condition detecting means;

correcting the tension detected by the yarn tension detecting means in correspondence with the rate of change in the winding condition; and judging whether the yarn manufacturing process is in a normal condition or not with reference to the corrected tension.

2. A method according to claim 1, wherein said winding condition to be detected is one of a transverse speed and a winding speed.

3. A method for monitoring a tension of a yarn in a yarn manufacturing process to detect an abnormality of the yarn manufacturing process while the yarn spun by a spinning device is wound by a winding device including a traverse mechanism, a spindle for attaching a bobbin thereto, and a contact roller adapted to contact the yarn wound around the bobbin to apply a surface pressure to the yarn, said tension of the yarn being detected by a yarn tension detecting means arranged on the upstream side of the winding device, said method comprising the steps of:

detecting a winding condition by a winding condition detecting means;

correcting an abnormal judging reference in correspondence with the rate of change in the winding condition; and judging whether the yarn manufacturing process is in a normal condition or not with reference to the corrected abnormal judging reference.

4. A method according to claim 3, wherein said winding condition to be detected is one of a transverse speed and a winding speed.

* * * * *